United States Patent [19]

Koch

[11] 4,049,359

[45] Sept. 20, 1977

[54] INSERTION OF COMPRESSIBLE SHEETS IN CONCRETE

[75] Inventor: Terry David Koch, Telford, Pa.

[73] Assignee: Inno-Cept Corporation, Lansdale, Pa.

[21] Appl. No.: 710,714

[22] Filed: Aug. 2, 1976

[51] Int. Cl.[2] ..... E01C 19/52; E01C 23/02

[52] U.S. Cl. ..... 404/89; 404/98

[58] Field of Search ..... 404/87, 88, 89, 98, 404/74

[56] References Cited

U.S. PATENT DOCUMENTS

| | | | |
|---|---|---|---|
| 974,673 | 11/1910 | Joslin | 404/87 X |
| 2,014,894 | 9/1935 | Heltzel | 404/87 X |
| 2,729,152 | 1/1956 | Carnes | 404/87 |
| 3,098,413 | 7/1963 | Guntert | 404/87 |
| 3,259,032 | 7/1966 | Suhr | 404/87 |
| 3,335,647 | 8/1967 | Thorp | 404/87 |
| 3,416,415 | 12/1968 | Worson | 404/87 X |
| 3,460,796 | 8/1969 | Brown | 404/89 X |
| 3,954,359 | 5/1976 | Larkin | 404/98 X |

*Primary Examiner*—Nile C. Byers

[57] ABSTRACT

Slip form concrete laying machines for forming curbs are equipped with apparatus which forcibly inserts compressible sheets downwardly in the freshly laid concrete and which prevents the spread of the curb as the sheet is inserted.

10 Claims, 6 Drawing Figures

INSERTION OF COMPRESSIBLE SHEETS IN CONCRETE

This invention relates to slip form, concrete laying machines and particularly to the combination therewith of an apparatus for inserting compressible strips or sheets in freshly laid concrete curbing. The compressible strips are made of a fibrous material and are forcibly pushed down into soft, newly formed curb. The invention also involves novel features of the apparatus for inserting the strips or sheets.

Slip form concrete laying machines are similar in some basic respects to paving machines for laying concrete sidewalks and roadways, in that both of them are wheeled, power driven vehicles having a concrete receiving hopper and a delivery orifice or chute which deposits and distributes the concrete in a predetermined area. They differ, however, in that the paving machine deposits the concrete over the wide area of a sidewalk or a roadway, whereas the curb laid by the slip form machine is quite narrow. The curb must maintain its upright shape and position after it is formed by the molding chute.

The paving machine deposits and spreads the concrete between rigid forms at the sides of the paving or roadway and the forms are not removed until the concrete has set. Consequently, a compressible expansion joint material can be forced down into the freshly laid concrete, such as is accomplished by the machine of U.S. Pat. No. 3,335,647 to J. T. Thorp, Jr., without materially disturbing the concrete.

In contrast to a paving machine, a slip form machine molds the concrete, as it is discharged from the machine, into the shape of an upstanding curb with nearly vertical sides. There are no forms which remain in place at the sides of the curb to maintain its shape until the concrete hardens. The concrete must be stiff enough so that it does not slump or spread out and it must retain this curb appearance while it is setting. It is apparent that to force a compressible strip or sheet of material down into freshly laid concrete without imparing or destroying the upright curb shape, presents a problem. This problem is made more complicated because the firmness and stiffness of the concrete used to make the curb, resists the entry of the compressible strip.

The apparatus of the present invention forces a strip or sheet of fibrous material down into the concrete of a freshly laid curb and although there are no semi-permanent forms at the vertical sides of the curb, the curb maintains its upright, unsupported shape. The present apparatus has the important feature that it can be attached to the slip form machines made by different manufacturers.

Figure 1:
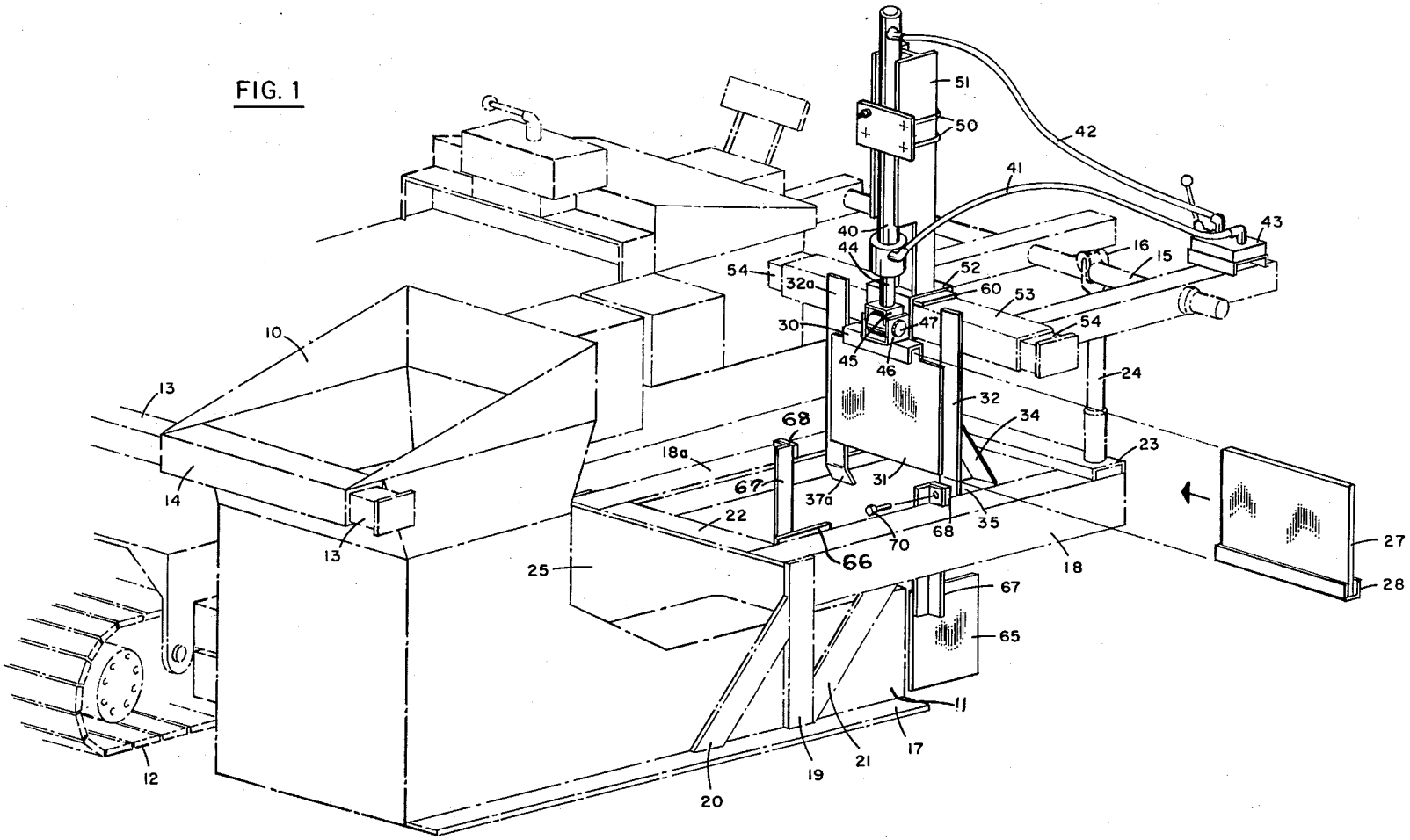
Figure 2:
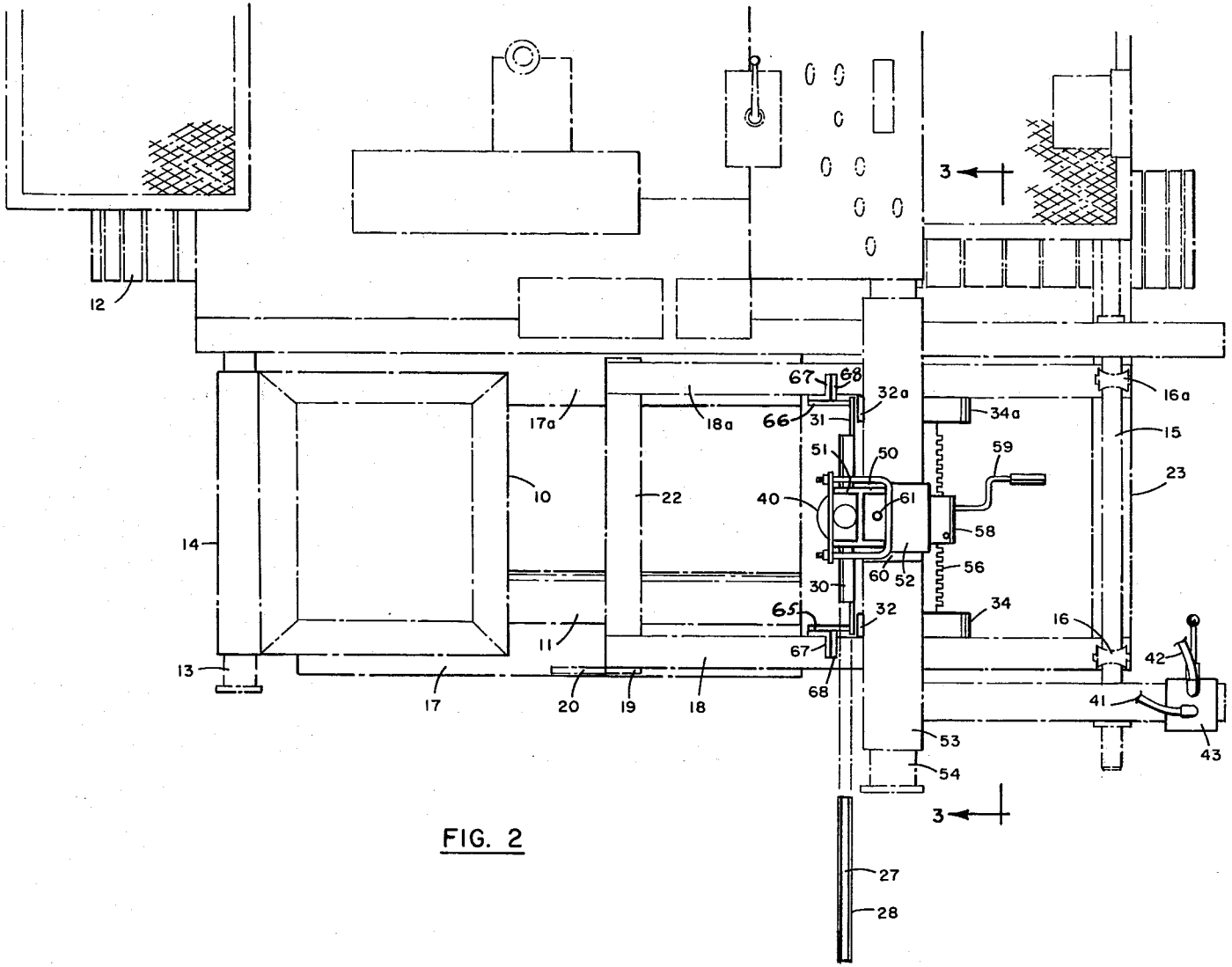
Figure 3:
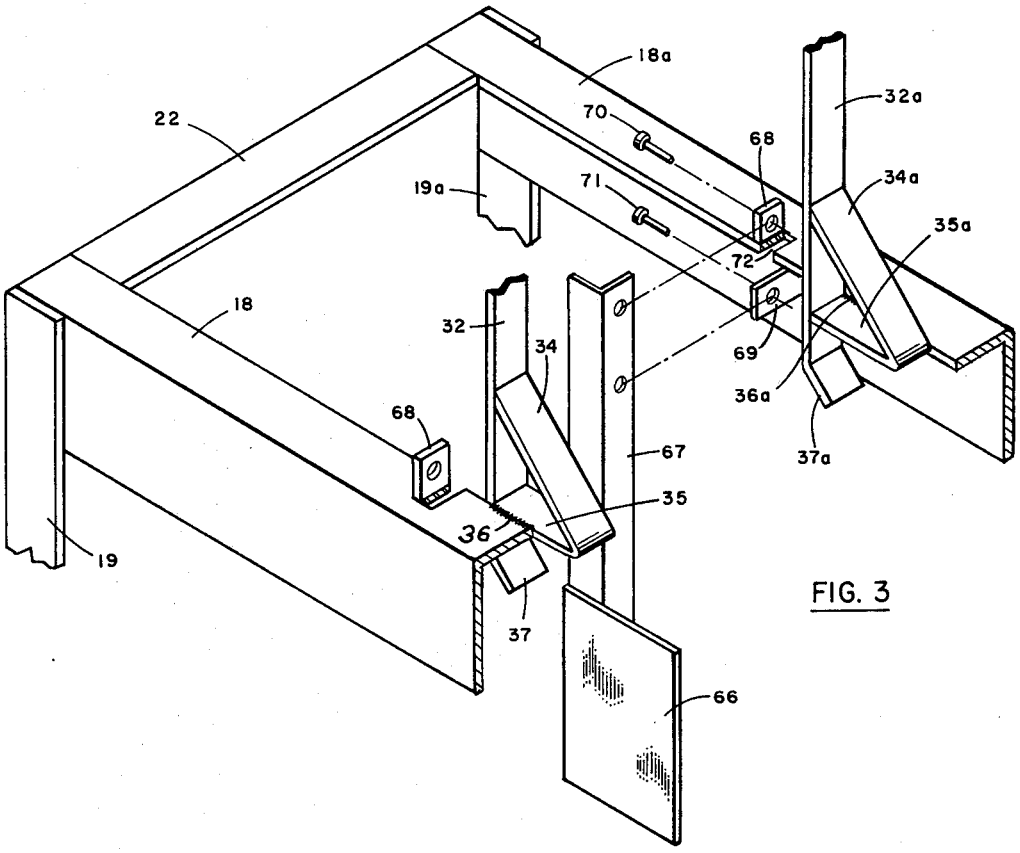
Figure 4:
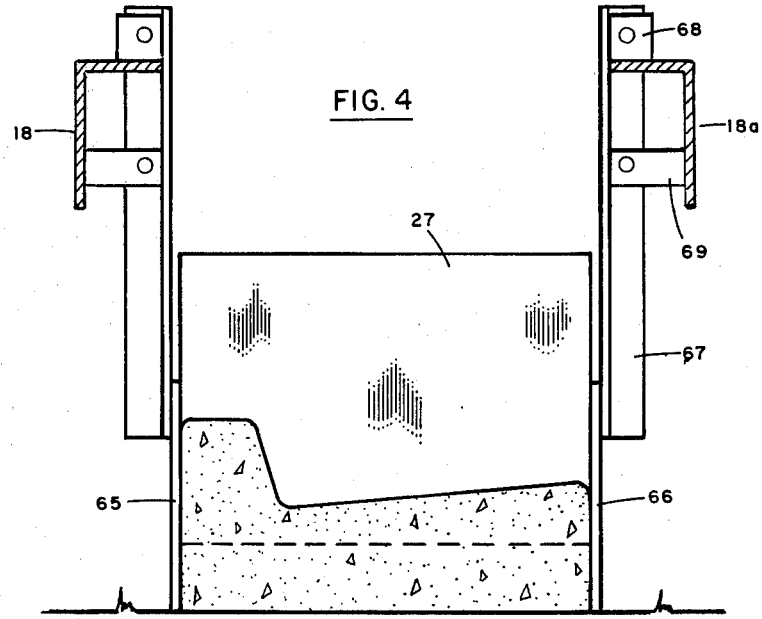
Figure 5:
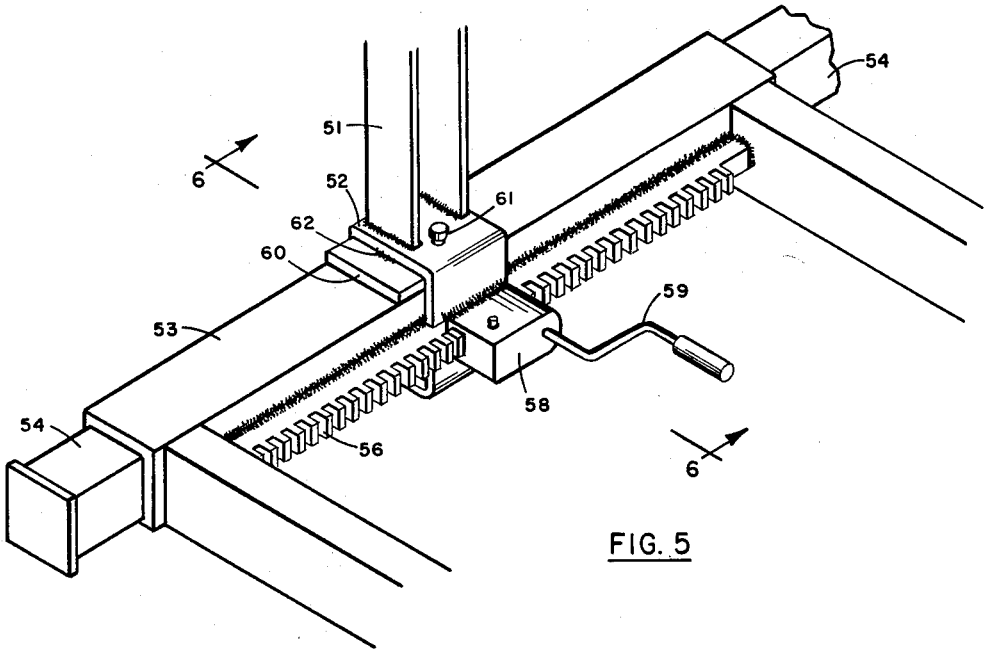
Figure 6:
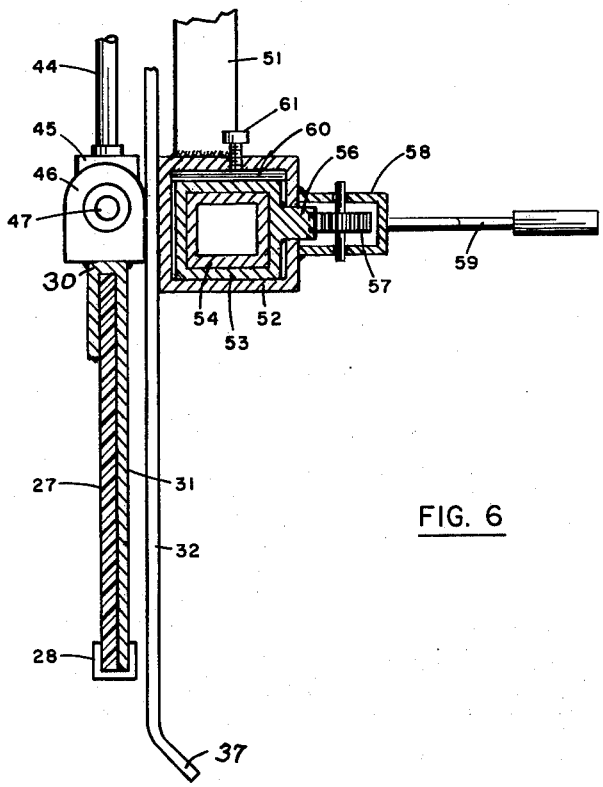

A preferred embodiment of the invention is illustrated in the accompanying drawings in which:

FIG. 1 is a perspective view looking toward the forward end of the slip-form concrete laying machine, at the side thereof to which the compressible strip inserting apparatus is attached, the slip-form machine being shown in construction lines, FIG. 2 is a plan view of FIG. 1, FIG. 3 is a perspective view on the line 3—3 of FIG. 2, upper parts of the apparatus being omitted, FIG. 4 is an elevational view from the right hand end of FIG. 3, the compressible sheet being partially inserted in the curb, FIG. 5 is a perspective, also on the line 3—3 of FIG. 2, but showing only some of the upper parts of the apparatus, and FIG. 6 is an elevational view on the line 6—6 of FIG. 5.

As has been stated above, the compressible strip inserting apparatus of the present invention may be applied to any of the presently manufactured slip form concrete curb laying machines. The machine shown in the drawings and to which the apparatus of the invention has been applied is a Robot Model manufactured by Curbmaster of America, Inc. The machine is shown in construction lines in FIGS. 1 and 2 and the strip inserting apparatus is shown in full lines to readily distinguish them and to clarify the manner of attachment of the apparatus to the machine. Other slip form machines will have structural parts which are the equivalent of the machine structural elements supporting the apparatus in these drawings.

The slip form machine includes a hopper 10 into which the freshly mixed concrete is to be poured from, for instance, a concrete mixing truck. The concrete moves downwardly in this vertical hopper and is discharged from a horizontal chute 11 having a discharge opening shaped to extrude and form the concrete in the desired cross-sectional shape. This discharge opening may form only an upstanding curb but the discharge opening may also be shaped to form the gutter which is frequently next to the curb as is shown in FIG. 4. However, whether or not the gutter is formed integrally with the curb the operation of the compressible strip inserting apparatus is the same.

The receiving hopper 10 and delivery chute 11 form a one piece unit as their parts are welded or bolted together. This unit is supported on the framework of the machine, as will be explained, so that it can be adjusted laterally or crosswise of the direction of movement of the machine. The machine is, of course, on power driven wheels or on the caterpillar treads one of which is shown at 12. This machine has its own motive power so that it moves ahead in the direction that the curb is to be formed. The machine should be steerable so that it can guided in a circle so that the curb will be laid in a curve to correspond to a bend in the road.

The framework of the machine includes a front, cross or transverse bar 13 which extends at right angles from the side of the machine and slidably mounted on it is the sleeve 14 which is welded or otherwise fastened to the hopper 10. By sliding the sleeve 14 along the bar 13 the hopper and chute can be brought to a position at a desired distance laterally of the machine. A similar supporting structure is located at the delivery end of the chute 11 as a cross or transverse bar 15 is attached to the framework of the machine and it is parallel to the cross bar 13. The chute 11 is suspended from and is movably mounted on the bar 15 by the roller 16 which is attached to the chute 11 at its discharge opening, by structural elements which will now be explained.

This attachment of the roller 15 to the discharge end of the chute 11 is not important to an understanding of the present invention but as here shown it includes at the near side of the apparatus, the horizontal longitudinal bars 17 and 18, the vertical upright bar 19 and the diagonal struts 20 and 21. The bars and struts, 17 to 21 inclusive are duplicated on the opposite inner side of the chute 11 and are here given the subscript *a*. For additional strengthening purposes, the two upper longitudinal bars 18 and **18*a*** are connected together by the cross bars 22 and 23. The roller 16 is rotatably attached to the top end of a post 24 which is fastened at its lower end to the cross bar 23. To the under side of cross bar 22 is attached a vertical plate 25 which is also attached to the chute to hold it up and in place.

The hopper 10 and chute 11 and their supporting structure including the sleeve 14 and rollers 16 and 16a are of a generally standardized construction so that this entire unit may be mounted on and suspended from the transverse bars 13 and 15 of different makes of machines of the slip form type. This unitized structure makes it possible to readily apply the compressible strip inserting apparatus of the invention to such a unitized hopper and chute arrangement. The parts which have been described up to this point are conventional in this art and the invention is applied to them.

The compressible, sheet material 27 is made of fibrous material, about three-fourths inch thick, and is generally standard in the industry. It preferably is rectangular in shape as this facilitates the application of force to press it down in the concrete and because it is fragile it can be trimmed to the shape of the curb (and gutter) after the concrete has hardened. To strengthen its lower edge as it is being inserted, a U-shaped or channeled strip 28 is slipped onto this lower edge with a frictional fit. It is allowed to remain on the fibrous sheet 27 after its insertion down through the concrete, as the concrete closes in around it. The strengthening strip 28 may be made of metal or of a rigid, strong plastic.

The top edge of the compressible sheet 27 is inserted in an inverted channel 30 which frictionally holds the sheet prior to the time that it is forced downwardly into the concrete. The sheet 27 is preferably inserted in a horizontal direction into the channel 30 as is indicated by the arrow. One side of this inverted channel is continued downwardly to form the backing plate 31. This backing plate prevents the compressible sheet from bending as it is pushed down in the concrete. It should be noted that the channel of the strengthening strip 28 is wide enough to accommodate both the sheet 27 and the backing plate 31. This prevents their separation as they are forced down into the fresh concrete. After the plate 31 is withdrawn upwardly, the sheet 27 and strengthening strip 28 remain in place in the concrete.

To guide the compressible sheet vertically downwardly, two vertically disposed guide plates 32 and 32a are provided and they are horizontally spaced apart so that the edges only of the backing plate 31 bear against them. The faces of these guide plates 32 and 32a, against which the plate 31 bears, is in the vertical plane of the fibrous sheet and backing plate and this plane is perpendicular to the lengths of the longitudinal bars 17 and 18. The guide plates 32 and 32a are of band like material and to strengthen them a triangular frame 34 and 34a of similar band material is welded to the rear side of each guide plate.

To hold the guide plates 32 and 32a upright and in place against the inner sides of the side bars 18 and 18a, respectively, they could be directly welded to the bars 18 and 18a. However, to provide added support, the horizontal bases 35 and 35a of the triangular strengthening frames are welded at 36 and 36a to the side bars 18 and 18a. The base 35 is perpendicular to the upright plate 32 and this is duplicated for base 35a and plate 32a.

As is best shown in FIG. 3 the guide plate 32 and 32a extend upwardly above the side bars 18 and 18a, preferably slightly above the backing plate 31 when in its uppermost position. Also, the guide plates 32 and 32a extend downwardly below the side bars 18 and 18a and their lower ends are curved at 37, 37a away from the backing plate 31 to make sure that the plate 31 is directed smoothly upwardly along the faces of plates 32, 32a. Obviously, the lower ends of the guide plates 32 and 32a must be above the top of the concrete curb being laid, if the concrete is laid at this area.

The inverted channel 30 which frictionally holds the compression sheet 27 serves as a cross head to push the sheet downwardly and for this purpose the double acting hydraulically operated pressure cylinder and piston 40 is provided. This is of standard manufacture and need not be described other then to point out that hose connections 41 and 42 at its upper and lower ends receive hydraulic pressure under the manual control of the two way valve 43. This valve 43 must be accessible to the person operating the sheet inserting apparatus and this person is ordinarily in addition to the slip form machine operator.

The lower end of the piston rod 44 has a yoke 45 attached to it and the top of the inverted channel 30 has a similar yoke 46 attached to it. A cross pin 47 through these yokes pivotally connects them together to compensate for misalignment of the pressure cylinder 40 and the guide plates 32 and 32a. This is important as there is no direct attachment between the cylinder and the guide plates as will be explained.

The cylinder 40 is fastened, as by straps 50, to a standard 51 and welded to the bottom of this standard 51 is an outersleeve 52 which fits over and rides on the inner, long sleeve 53 so that the cylinder 40 can be moved closer to or away from the side of the slip form machine as will be explained. This correspondingly makes it possible to position the inverted channel or cross head 30 at the desired place between the guide plates 32 and 32a. In some machines the horizontal bars 18 and 18a may be spaced apart different distances and this will locate the vertical guide plates 32 and 32a different distances apart from each other. The inner sleeve 53 is slidably mounted on a cross bar 54 which is a part of the slip form machine. The inner sleeve 53 is adjustable along the projecting bar 54 for a purpose which is not important here.

The sliding movement of the standard 51 and its sleeve 52, along the inner sleeve 53 makes it possible to properly position the cylinder 40 above the concrete in which the sheet 27 is to be inserted. To make it easy to move the outer sleeve 52 along the sleeve 53 a toothed rack 56 is affixed to the side of the inner sleeve 53 and a pinion 57 within the gear box 58 meshes with it. This gear box is welded to the outer sleeve 52 at a slit therealong which is provided to admit the rack teeth 56, as is best shown in FIG. 6.

The pinion gear 57 is turned by a worm gear (not shown) fastened to the crank shaft 59 which is rotatably mounted in the gear box 58. This geared connection makes it possible to make an exact positioning of the backing plate 31 so it will properly bear on the guide plates 32 and 32a. To make doubly certain that the outer sleeve 52 is fixedly held in a set position along the inner sleeve 53, a friction plate 60 is interposed between them at the top of the sleeve 53. A bolt 61, threaded in the top of the outer sleeve 52, firmly and frictionally forces the plate 60 against the top of sleeve 53. A slight welding spot may be applied at 62 to hold the plate 60 in place but not prevent its clamping movement against sleeve 53.

The vertical guide plates 32 and 32a are located directly above the discharge opening from the chute 11 so that the compressible strip 27 is forced down in the concrete just as it is emerging from the chute opening. As the concrete is made quite stiff so that it will maintain its upright form without slumping and without the need for forms along side of the curb until the concrete sets, the pressure of the fibrous strip down in the fresh concrete will have some tendency to bulge the sides of the curb outwardly. To overcome this it is a feature of the invention to provide paddle plates 65 and 66 which are disposed at the chute opening and on opposite sides of the point of entry of the fibrous sheet down in the concrete.

These paddle plates are vertical and parallel to each other and are spaced apart the distance of the widest width of the curb including the gutter if one is formed with the curb. The paddle plates, in effect, are rearward continuous extensions of the extreme width of the discharge chute. These paddle plates bear on the sides of the curb and gutter and prevent its spread under the pressure of the compressible fibrous sheet.

The paddle plates 65 and 66 are similarly held in place and therefore a description of paddle 66 should suffice. Paddle plate 66 is secured, as by welding, to the lower end of an angle bar 67 which extends up to and preferably above the side bar 18a. An attachment lug 68 is welded or otherwise affixed to the top of bar 18a and another attachment lug 69 is affixed to the inner side of bar 18a. The angle bar 67 is fastened by clevis pins 70 and 71, passing through the holes as indicated, to the lugs 68 and 69, and secured by cotter pins (not shown). The bar 18a should be notched at 72 to accommodate the angle bar 67 and permit the disposition of the opposing faces of the paddle plates at the vertical sides of the curb and the gutter if the latter is formed.

It is important that the paddle plates 65 and 66 not be firmly attached to the lugs 68 and 69 by the clevis pins 70 and 71 but that the connection be a loose one which will permit a slight swivel of the plates. This permits the plates 65 and 66 to turn about vertical axes when the curb is being laid in a curve. If this yielding of the paddle plates is not permitted they could dig into the freshly laid cement as the machine is turning a curve in the road.

To set up the machine and apparatus for use, the clamping bolt 61 is loosened and the crank 59 is turned to accurately locate the backing plate 31 relative to the guide plates 32, 32a. This adjustment is made to correspond to the positioning of the hopper 10 and chute 11 closer to or further away from the side of the machine. A compression sheet 27 and strengthening strip 28 are then moved in place so the top of the sheet is in the channel 30 and the strip 28 embraces the lower end of the backing plate 31.

As the slip form machine moves forwardly and the concrete issues from its chute to form the curb (and gutter, if included) the machine is stopped and the valve 43 is operated so that pressure is applied to the channel 30 to force the sheet 27 down through the freshly formed concrete. The paddle plates 65 and 66 maintain the vertical sides of the concrete at the point of insertion of the sheet 27 to overcome the spreading action of the sheet 27 as it is pushed down in the concrete.

When the sheet 27 reaches the bottom of the concrete the valve 43 is manually reversed to withdraw the backing plate 31 upwardly to its initial position. Forward movement of the machine is then continued so that the curb is extended and after a preset length of curb the machine is again stopped and another compressible sheet is inserted. This operation is repeated at regular distances.

The compressible sheets are inserted in the concrete vertically downwardly as the piston rod 44 moves vertically downwardly since it is perpendicular to the lengths of the longitudinal bars 18 and 18a. Also, the sheets 27 ae inserted in the concrete perpendicularly crosswise of the concrete curb as the backing plate 31 and guide plates 32 and 32a are in parallel planes which are perpendicular to the lengths of the bars 18 and 18a. This uniformity of operation is maintained because the supporting cross bars 13, 15 and 54 are attached to the slip form machine so that they are parallel to each other and bars 18 and 18a are perpendicular to them.

If no gutter is being formed, the sheet 27 would be only as long as the width of the curb and the paddle plates would be positioned a distance apart corresponding to the width of the curb by spacing the plates 65 and 66 away from the angle bars and closer together.

I claim:

1. The combination with a slip form concrete curb laying machine having a framework and, carried thereby, a hopper for receiving freshly mixed concrete and a chute therefrom having an opening for discharging the concrete in an upstanding shape, of a compressible sheet inserting apparatus supported by said machine and comprising a holder for releasibly retaining a compressible sheet of fibrous material beyond and above the discharge opening and perpendicular to the chute length, power actuated means for moving said holder vertically downwardly to force a sheet through the deposited concrete and paddle plates disposed as lengthwise extensions of the opposite sides of the chute and below said holder to bear against the opposite sides of the concrete and overcome bulging of the concrete as the sheet is inserted.

2. The combination of claim 1 in which said holder is an inverted channel which grips the top edge of the sheet.

3. The combination of claim 1 in which said holder is an inverted channel one side of which extends vertically downwardly to serve as a backing plate for the sheet.

4. The combination of claim 3 in which a channeled strengthening strip embraces the lower edges of the sheet and the backing plate.

5. The combination of claim 3 which also comprises vertical guide plates at the side edges of the backing plate to guide the vertical movements of said holder and its backing plate.

6. The combination of claim 1 in which said holder and said power means are pivotally connected together by a horizontal pin.

7. The combination of claim 1 in which said holder is mounted for adjustment transversely of the chute opening.

8. The combination of claim 1 in which said paddle plates are loosely mounted so that they can yieldably turn about vertical axes when the machine is turning in a curve.

9. Apparatus for inserting a compressible sheet of material into a newly laid concrete curb comprising a holder for releasibly retaining a sheet of such material, power actuated means connected to said holder for moving the holder vertically downwardly to force a sheet through the deposited concrete and paddle plates disposed below said holder so that they will bear against the sides of the deposited concrete at the insertion point of a sheet.

10. Apparatus according to claim 9 in which said holder is an inverted channel one side of which extends vertically downwardly to serve as a backing plate for the sheet and said backing plate moves downwardly between said paddle plates.

* * * * *